United States Patent [19]

Matsuura

[11] Patent Number: 4,745,436

[45] Date of Patent: May 17, 1988

[54] COPYING MACHINE

[75] Inventor: Hirokazu Matsuura, Yamatokoriyama, Japan

[73] Assignee: Sharp Kabushiki Kaisha, Osaka, Japan

[21] Appl. No.: 753,064

[22] Filed: Jul. 9, 1985

[30] Foreign Application Priority Data

Jul. 10, 1984 [JP] Japan ..... 59-144012

[51] Int. Cl.[4] ..... G03G 15/00; G03G 21/00

[52] U.S. Cl. ..... 355/14 R; 355/75

[58] Field of Search ..... 355/14 R, 14 C, 14 FU, 355/75, 145 H, 35 H, 3 R

[56] References Cited

U.S. PATENT DOCUMENTS 3,945,728 3/1976 Crandell ..... 355/75
4,248,526 2/1981 Shunichi et al. ..... 355/14 R
4,349,269 9/1982 Okada ..... 355/14 FU X

FOREIGN PATENT DOCUMENTS 58-194052 11/1983 Japan ..... 355/14 C
58-221854 12/1983 Japan ..... 355/14 C
59-22074 2/1984 Japan ..... 355/14 FU

*Primary Examiner*—Fred L. Braun
*Attorney, Agent, or Firm*—Birch, Stewart, Kolasch & Birch

[57] ABSTRACT

A copying machine with a power saving mode that can be canceled automatically in response to any one of the operations relating to the start of the copying operation, such as placing a manuscript on the copy machine platen, closing a cover on a manuscript or pressing the copy start button, so as to enable rapid copying while reducing copying time.

10 Claims, 4 Drawing Sheets

COPYING MACHINE

BACKGROUND OF THE INVENTION

1. Field of the Invention

The present invention relates to a copying machine, and more particularly to a copying machine comprising means for cancelling a saving power mode automatically.

2. Description of Related Art

In general, in a copying machine, detectors which detect if a manuscript is in place or not, if a manuscript cover is open or shut, if a manual paper feeding cover is open or shut, if a front cover is open or shut after maintenance, if a paper cassette is set, the size of papers which are set in the cassettes and so on, are arranged at each respective position. In an electrophotographic copying machine comprising an image video forming device which uses toner, the copying operation is performed as follows. The toner material is electrostatically attracted to an electrostatic latent image corresponding to the image of the manuscript to be copied, transferred imagewise to a copying paper, and the toner image formed on the paper is fixed. In the fixing operation, the copying paper is passed between two heating rollers heated at a constant temperature by a heating lamp, and the paper and toner are heated and pressed, fixing the toner image. During the copying operation it is necessary that the heating rollers be kept at a predetermined temperature of about 200 degrees Centigrade which is defined by the summation of a normal fixing temperature at which the toner can be fixed on the copying paper and a compensation temperature for compensating for temperature drop due to consecutive copying operations. In order to control the temperature of the heating rollers, the time for turning on the heating lamp is controlled by a thermister sensing the temperature of the heating rollers, and a temperature control circuit. It takes a few minutes to increase the temperature of the heating rollers from room temperature to the predetermined temperature after turning on the main switch of the copying machine and turning on the heating lamp at the beginning of the copying operation. In the above copying machine, whenever the copying operation is completed, the main switch may be turned off, and whenever the copying operation is started, the main switch may be turned on. With the above operation, it takes a long time to heat the heating lamp to the desired setting temperature (the process is called the warming phase), and the working efficiency of the copying machine could be decreased. To the contrary, with the main switch always turned on it is always possible to begin to operate the copying machine immediately, however, the cost of the copying operation may go up because of increasing the power consumption. For this reason, in order to reduce the warming up time and save on power consumption, there may be provided a power saving mode in the copying machine in which the thermister and the temperature control circuit control the heating lamp to keep the heating rollers at about 100 degrees Centigrade, and also there may be a switch for selecting the power saving mode during the operation phase of the copying machine. A timer which counts the waiting time of the copying operation may be provided. The power saving mode can be enabled when a constant time has passed during the waiting condition of the copying machine when the copy button for starting the copying operation has not been pressed with the main switch turned on, or when the power saving mode switch is pressed. On the other hand, when the instant power saving mode switch is turned off or when the copy button is pressed, the power saving mode can be canceled.

However, in the conventional copying machine provided with the capability to select a power saving mode and cancelling thereof, it is necessary for an operator to turn off the power saving mode switch or turn on the copy button for effecting the copy. Therefore, the copying operation is complicated. As one example, assuming that an operator fails to turn off the power saving mode switch, that is, without cancelling the power saving mode prior to the following operations such as setting the number of copies to be made, setting the magnification in the copying machine, placements of the manuscript to be copied, changing the cassette of the copying paper and so on, the time of the copying operation may be extended since the warming up operation of the heating rollers starts after these operations. Also, it is a drawback of the conventional copying machine that it might be necessary to operate these plural operations many times before starting the copying operation, resulting in considerable loss of time.

SUMMARY OF THE INVENTION

An essential object of the present invention is to solve the above problem and to provide a copying machine with a function which is capable of canceling a power saving mode automatically thus enabling the copying operation to be preformed simply and thus reduce the required copying time.

It is another object of the present invention to provide a copying machine with the capacity to cancel the power saving mode as soon as the copying operation is started, so that preparation for the copying can be performed at the same time that the warming up operation is performed.

According to the present invention, there is provided a copying machine comprising means for placement of a manuscript in the copying machine for copying, cover means for covering the manuscript and the placement means during copying the content of the manuscript on a copy paper, means for initiating the start up of the copying operation, means for effecting a power saving mode by which the power consumption of the copying machine is decreased in a period during which the copying operation is not performed, wherein the improvement comprises the inclusion of a sensor means for generating a signal when any one of the operations relating to the copying operation is initiated and means for cancelling the power saving mode automatically in response to this signal.

By this arrangement it is possible to start the warm-up operation by canceling the power saving mode as soon as the user begins the copying operation during the power saving mode by response to a detector, which detects if the manuscript cover is open or shut in the flow chart and so on, and also making it possible to copy at the same time during the warm-up operation. Therefore, the present invention has the advantage that the copying operation is operated efficiently, reducing the operation time.

DETAILED DESCRIPTION OF THE INVENTION

Figure 1:
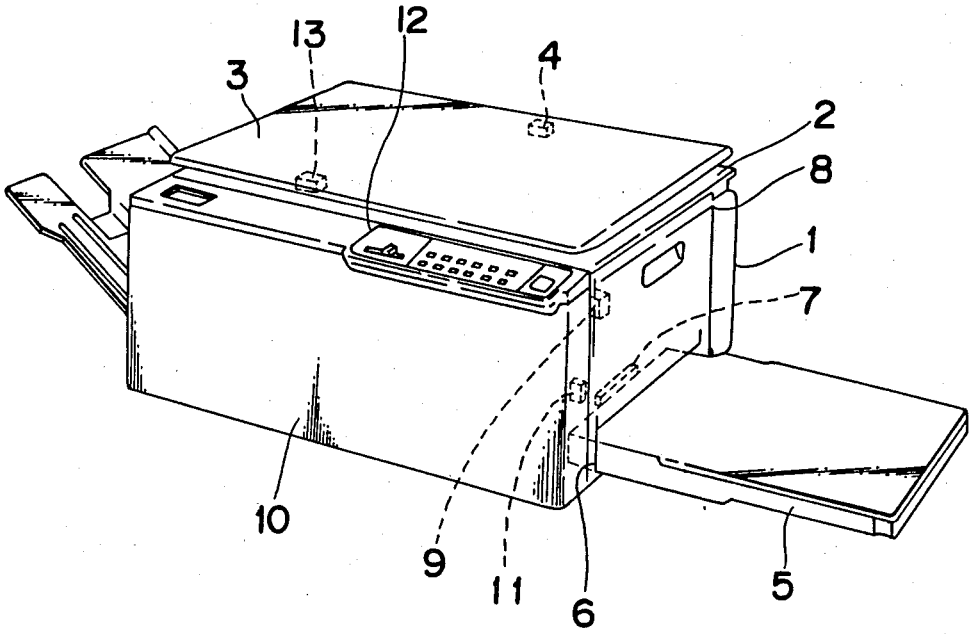
FIG. 1 is a perspective view showing the copying machine to which the present invention is applied.

FIG. 1 represents a copying machine which includes a function of cancelling a power saving mode automatically according to the present invention.

Referring to FIG. 1, a manuscript support or platen 2 at the top of the body 1 of the copying machine is covered with a manuscript cover 3 which can be opened or shut freely at a fulcrum of a hinge arranged at the rear end of the copying machine. A micro switch 4 which detects if the manuscript cover 3 is open or shut is arranged under the manuscript cover 3. A photosensor 13 which detects if the manuscript is in place or not is arranged under the manuscript platen 2. There is defined a cassette insert opening 6 into which a paper cassette 5 is inserted at the lower side of the right hand side of the body 1 of the copying machine which is the paper feeding side, and a paper size detector 7, arranged at the position in touch with a paper size display part at the front end of the paper cassette, inside of the cassette inserting opening 6. At the upper part of the right hand side of the body 1 of the copying machine a manual paper feeding part is arranged, and a micro switch 9, which detects if a manual paper feeding cover 8 is open or shut, is arranged inside of the manual paper feeding cover 8 so that the cover 8 can be opened or shut freely at a fulcrum of a hinge arranged at the lower part of the right hand side. Moreover, a micro switch 11 is arranged at the end of the right hand side of the body 1 of the copying machine, which detects if the front cover 10 is open or shut. An operation unit 12 is provided at the top surface of the body 1 of the copying machine, the unit 12 including various input devices, such as an exposure value setting member, numerical keys, a copy button etc., various warning lamps, a display device and a saving power switch operated when an operator selects the power saving mode. The temperature of the heating rollers arranged inside of the body 1 of the copying machine (not shown) for fixing the toner image on a copy paper is measured by a thermister, and a heating lamp will be turned on or off in accordance with the output level of the thermister, so that the temperature of the heating rollers can be kept within the range of a predetermined set temperature which is the summation of a fixing temperature (about 180 degrees Centigrade) at which the toner image can be fixed on the copy paper and the temperature drop as a result of continuous copying.

When a timer has counted a predetermined time (the suitable time is one minute) after the copying operation is over and the timer starts to count while the main switch has been turned on, or when the power saving switch at the operation part 12 is activated, the power saving mode in which the temperature of the heating rollers is kept at about 130 degrees Centigrade, which is the suitable temperature, below the fixing temperature is performed. During the power saving mode, when a detecting signal outputted from the micro switches 4, 9, and 11 or the paper size detector is transferred into a central processing unit 20 (referred to as CPU hereinafter) of the copying machine, or when an input signal outputted by operating the input devices at the operation part is transferred into the CPU 20 of the copying machine, the power saving mode will be canceled.

Figure 2:
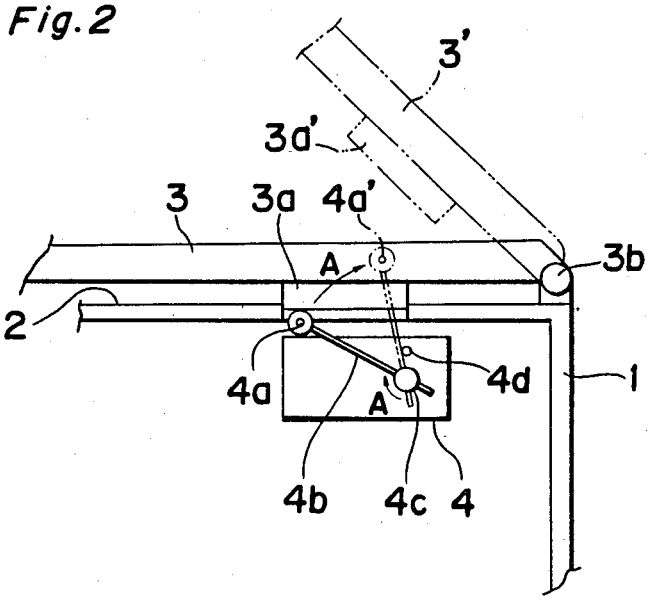
FIG. 2 is a partial side view showing a detector for detecting if a manuscript cover is open or shut, FIGS. 3 (A) and (B) are flow charts showing one example of an operation of a copying machine according to the present invention comprising a function of cancelling a power saving mode automatically.

FIG. 2 shows one example of a way of mounting the micro switch 4 used for detecting if the manuscript cover 3 is open or shut.

The micro switch 4 is secured to the body 1 of the copying machine by using a metal fitting member (not shown). An end of the switch arm 4*b* is coupled to a rotational shaft 4*c* which thrusts out of the side surface of the micro switch 4, and a disk 4*a* is rotatably supported at another end of the switch arm 4*b*. The rotational shaft 4*c* is normally exerted in the direction shown by the arrow A by an elastic force of a spring (not shown) arranged inside of the micro switch 4. A pressing member 3*a* is arranged below the surface of the manuscript cover 3 at the position where the disk 4*a* is pressed against the elastic force of the spring. When the manuscript cover 3 is shut, as shown by a solid line in FIG. 2, the disk 4*a* is pressed by the pressing member 3*a* and positioned as shown. While the manuscript cover 3 is being moved to the position at a fulcrum of a hinge as shown using a chain double-dashed line in FIG. 2 after the manuscript cover 3 is opened, the switch arm 4*b* is rotated in the direction of the arrow A about the rotational shaft 4*c* of the micro switch 4 by the elastic force of the spring, so that the switch arm 4*b* is moved to the position 4*a*' where the switch arm 4*b* touches a stopper 4*d*. The rotation of the shaft 4*b* causes a switch means inside of the body of the micro switch 4 to be actuated, whereby a signal representing either an open state or shut state of the cover 3 is outputted to the CPU 20. The micro switch 9 and 11 are respectively arranged as to detect respectively if the manual feeding paper cover 8 and the front cover 10 are open or shut.

FIGS. 3 (A) and (B) are flow charts showing one example of an operation of the copying machine comprising a function which is to cancel a power saving mode automatically according to the present invention.

Figure 3A:
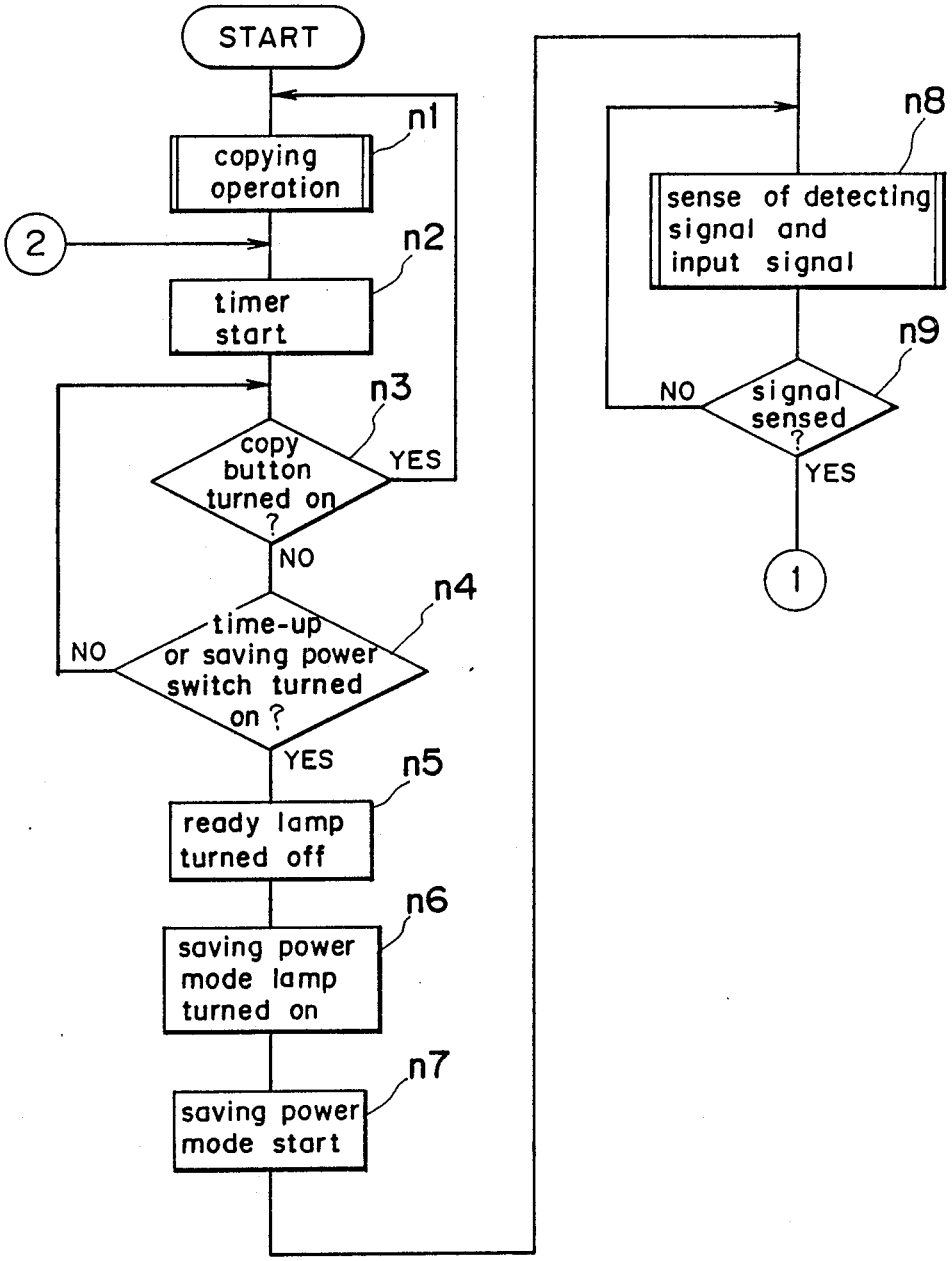
Figure 3B:
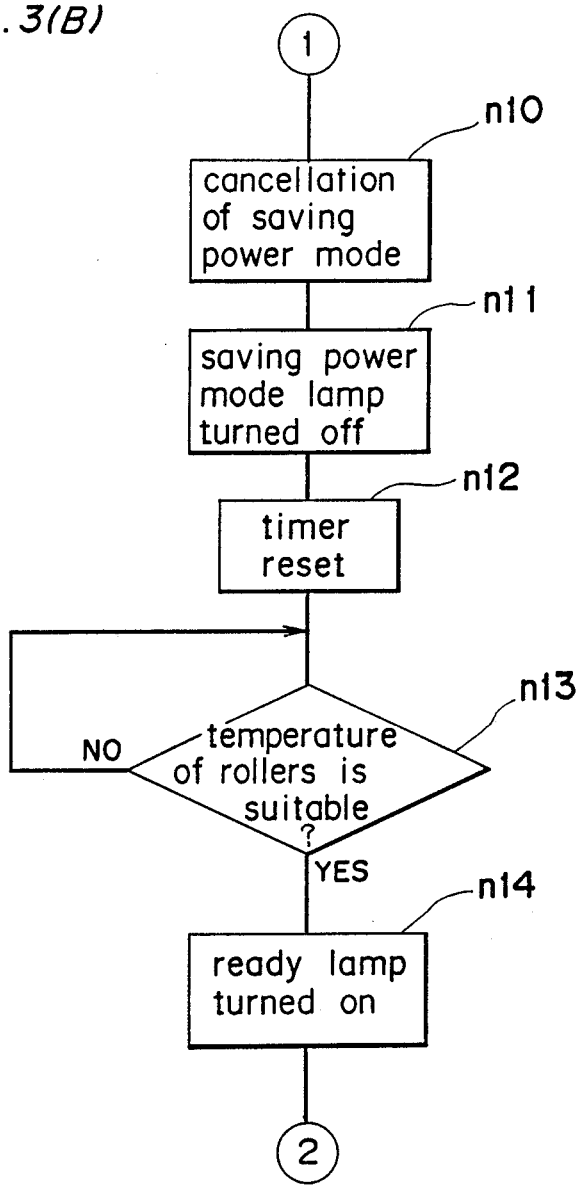
Figure 4:
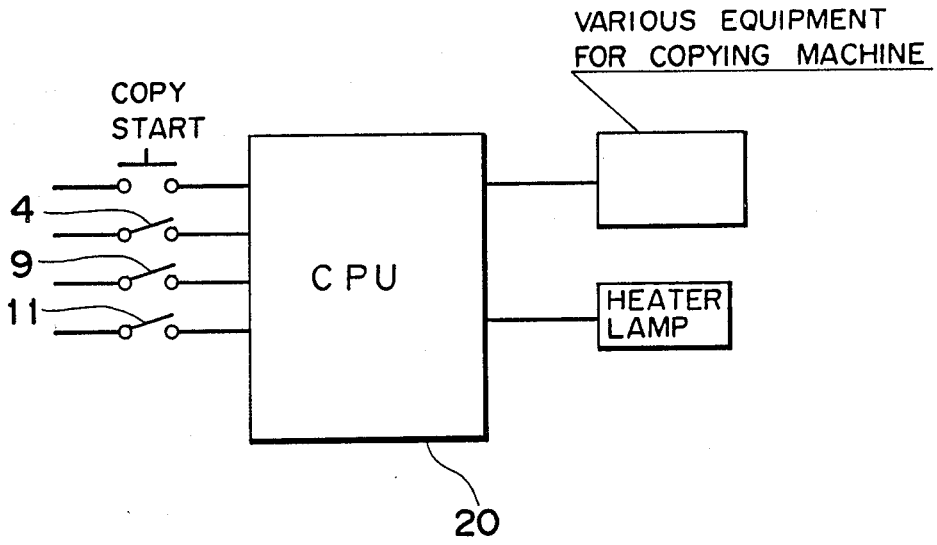
FIG. 4 is a schematic diagram showing the control device used in the copying machine according to the present invention.

The program shown in FIGS. 3(A) and 3(B) can be performed under the control of the CPU 20 provided in the copying machine. The CPU 20 stores the control program for executing the program shown in FIGS. 3(A) and 3(B).

As soon as the copying operation is completed at step n1, the timer starts at count the waiting time at step n2. At n3 and n4, the program flow step goes back to n1 and the copying operation is started as soon as the copy button is turned on before the timer time is up. When the timer time up, without operating the copy button or when the power saving switch is operated, the step goes to n5. Then a ready lamp is turned off, and at n6 and n7 the power saving mode lamp is turned on and the power saving mode is performed. After that, at n8, the signals outputted from the micro switches 4, 9, and 11, the paper size detector 7 and the copy button at the opposite site are monitored. After a signal from any one of the input devices is detected at n9, the power saving mode is canceled at n10 and the temperature of the heating rollers is increased to the set temperature at which the copying operation can be performed. The lamp of the power saving mode is turned off at n11, and the timer is reset at n12. When the temperature of the heating rollers reaches the set temperature at n13, the ready lamp is turned on at n14 and the program flow goes back to n2.

Finally, in the above operation, it is possible to change the counting time counted by the timer and the set temperature of the heating rollers during the power saving mode in accordance with the use operation. Moreover, omitting the lamp which indicates operating the power saving mode does not cause any inconvenience in the operation. It is possible to apply the present invention to any typical copying machine comprising other functions which are for example to perform the magnification copying operation and so on.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A copying machine comprising:

body means, a platen means mounted on said body means for receipt of a manuscript, platen cover means mounted over said platen means for opening to expose said platen means and for closing to cover said platen means and said manuscript thereon, operating means for signaling the start of a copying operation, power saving means for enabling a power saving mode by which power consumption of said copying machine is decreased in a period during which said copying operation of said copying machine is not performed, operating sensor means for detecting the start of said copying operation from said operating means wherein said operating sensor means emits a canceling signal in response to said start of said copying operation, platen cover sensor means for emitting a canceling signal when said platen cover means is opened or closed to start said copying operation, and canceling means for canceling said power saving mode automatically in response to said canceling signal.

2. The copying machine according to claim 1, wherein said copying machine further comprises manual paper feeding means for feeding said manuscript to said platen means, manual paper feeding cover means for opening to receive said manuscript for said manual paper feeding means and for closing to cover said manual paper feeding means, and a manual cover sensor for emitting a canceling signal when said manual paper feeding cover means is opened or closed to start said copying operation.

3. The copying machine according to claim 2, wherein said copying machine further comprises front cover means which opens and closes mounted on said body means for providing access to the inside of said copying machine and front cover sensor means for emitting a canceling signal when said front cover means is opened or closed to start said copying operation, a paper cassette for insertion into said copying machine, a paper cassette insertion opening for receiving said paper cassette, and a paper cassette sensor means in said paper cassette insertion opening for emitting a canceling signal when said paper cassette insertion opening receives said paper cassette to start said copying operation, a manuscript sensor means operatively associated with said platen means for emitting a cancelling signal when said manuscript is placed on said platen means to start said copying operation, and wherein said power saving means includes a timer means for counting a waiting time period after said copying operation is completed so that said power saving mode can recover after said waiting time period.

4. The copying machine according to claim 3, wherein said platen cover sensor means, said manual cover sensor means, and said front cover sensor means each comprise microswitches, and wherein said manuscript sensor means comprises a photosensor.

5. The copying machine according to claim 1, wherein said power saving means includes a timer means for counting a waiting time period after said copying operation is completed so that said power saving mode can recover after said waiting time period.

6. The copying machine according to claim 1, wherein said copying machine further comprises front cover means which opens and closes mounted on said body means for providing access to the inside of said copying machine and front cover sensor means for emitting a canceling signal when said front cover is opened or closed to start said copying operation.

7. The copying machine according to claim 1, wherein said copying machine further comprises a paper cassette for insertion into said copying machine, a paper cassette insertion opening for receiving said paper cassette, and a paper cassette sensor means in said paper cassette insertion opening for emitting a canceling signal when said paper cassette insertion opening receives said paper cassette to start said copying operation.

8. The copying machine according to claim 1, wherein said copying machine further comprises a manuscript sensor means operatively associated with said platen means for emitting a cancelling signal when said manuscript is placed on said platen means to start said copying operation.

9. The copying machine according to claim 1, wherein said platen cover sensor means comprises a pressure member mounted on said platen cover means over said platen means and a microswitch mounted under said platen means for receiving said pressure member when said platen cover means is closed, said microswitch emitting a canceling signal when said platen cover means is opened or closed to start said copying operation.

10. The copying of claim 9, wherein said microswitch of said platen cover sensor means further comprises a microswitch case, a switch arm rotatably mounted on said microswitch case, said switch arm including an end portion for contacting said pressure member, wherein said switch arm rotatably moves to an open position when said platen cover means is opened, and wherein said switch arm is forced to rotatably move into a closed position by said pressure member when said platen cover means is closed, said microswitch emitting a canceling signal when said switch arm is in an open or closed position to start said copying operation.

* * * * *